US005781512A

United States Patent [19]

Pantet

[11] Patent Number: 5,781,512

[45] Date of Patent: Jul. 14, 1998

[54] POCKET AND TABLE WATCH WITH A SUSPENSION AND SUPPORT DEVICE

[75] Inventor: Laurent Pantet, Nods, Switzerland

[73] Assignee: Eta SA Fabriques d'Ebauches, Grenchen, Switzerland

[21] Appl. No.: 782,942

[22] Filed: Jan. 13, 1997

[30] Foreign Application Priority Data

Jan. 26, 1996 [CH] Switzerland ..... 00207/96

[51] Int. Cl.[6] ..... G04B 37/00; A47F 7/00

[52] U.S. Cl. ..... 368/316; 248/114

[58] Field of Search ..... 368/276, 284, 368/294, 295, 301, 307, 316, 317; 248/114–116, 288.11, 288.31

[56] References Cited

U.S. PATENT DOCUMENTS

| | | | |
|---|---|---|---|
| 2,181,753 | 11/1939 | Wewetzer et al. | 368/116 |
| 2,527,090 | 10/1950 | Bauman | 368/316 |
| 2,567,564 | 9/1951 | Ingraham | 368/316 |
| 5,039,042 | 8/1991 | Zaugg | 248/115 |

FOREIGN PATENT DOCUMENTS

| | | |
|---|---|---|
| 616 603 | 2/1927 | France . |
| 678 308 | 3/1930 | France . |
| 3 400 329 | 7/1985 | Germany . |
| 50581 | 10/1909 | Switzerland . |
| 121 145 | 6/1927 | Switzerland . |
| 323 379 | 7/1957 | Switzerland . |

*Primary Examiner*—Vit W. Miska
*Attorney, Agent, or Firm*—Griffin, Butler Whisenhunt & Szipl

[57] ABSTRACT

A watch (1) whose case (3) comprises a groove (7) on its periphery is mounted in a removable manner in a suspension and support device consisting of two parts (11 and 12) attached by a hinge (13). The first part (11) has the shape of an resilient open ring which engages in the groove of the case. The second part (12) is substantially flat and comprises suspension means opposite to the hinge (13), and a shoulder capable of stopping it at an acute angle with respect to the first part. In this case, the assembly may be placed on a table (34) or any other horizontal surface.

10 Claims, 2 Drawing Sheets

POCKET AND TABLE WATCH WITH A SUSPENSION AND SUPPORT DEVICE

The present invention concerns a pocket and table watch, comprising a watch case and a suspension and support device mounted on said case and provided with suspension means, said device comprising a hinge allowing the watch to be placed selectively in a suspension position and in a table position in which, when the watch is placed on a substantially horizontal surface, said device holds the case in a standing or inclined position with respect to said surface, the suspension and support device comprising two parts attached to each other by the hinge, namely a first part mounted on the periphery of the case and a second substantially flat part provided with a suspension means, the two parts abutting against each other to stop the first part at an acute angle with respect to the second part in the table position.

The invention also concerns a suspension and support device intended to be mounted in a removable manner on a watch case and provided with suspension means, said device comprising a hinge allowing the watch to be placed selectively in a suspension position and a table position in which, when the watch is placed on a substantially horizontal surface, said device holds the case in a standing or inclined position with respect to said surface, the device comprising two parts attached to each other by the hinge, namely a first part intended to be fixed to the case and a second substantially flat part provided with a suspension means, the two parts abutting against each other to stop the first part at an acute angle with respect to the second part in the table position.

Conventional pocket watches comprise a suspension ring, called a bow and intended for attaching a small chain. Such ring is usually hinged onto a fixed element called a pendant, which bears the stem and the winding crown. In Swiss patents no. 50581 and no. 121 145, it has been proposed to incorporate this ring in a stirrup which can tip up to act as a stand allowing the watch to be placed on a table or another piece of furniture in the same way as a miniature clock. In the past, such a watch was called a watch with a stand or a portfolio-watch. However, systems of this type have been abandoned because they require special elements for securing and blocking the stand in position on the watch case. In particular, because of friction, these systems wear out and obviously do not offer the best guarantee of stability and long term reliability.

Patent document EP-A-0 290 935 illustrates, in FIGS. 2 and 6 thereof, a pocket watch fitted with a suspension and support device which comprises three parts. The first part is a receptacle having a cavity in which the watch case is held by resilient wings, and an upper bracket having a spherical recess open in a lateral direction. The second part is a suspension support having a ball which engages in a removable manner in said spherical recess. The third part is a separate stand having a similar ball and a shoulder which may abut against the back of the first part to hold the watch in an inclined position on a table, when such third part is set in lieu of the second part. The existence of three parts, one of which must always be taken off, constitutes a major drawback for users, all the more so since the stand is too bulky for the user to carry constantly with him.

Swiss patent no. 323 379 discloses a watch of the type defined in the preamble, which may sometimes be suspended and sometimes be placed as a stand. Its suspension and support device comprises three parts, the first of which forms an annular frame in which the watch case is mounted so as to pivot about an axis arranged horizontally. This mounting comprises a rigid lug which projects backwards and upwards. A second flat part is hinged at one of its ends onto the lug and at the other end onto a third part belonging to a key-ring. In the so-called table position, the device acts as a stand by resting on the table via the third part and via the hinge of the second part onto the first. Since said hinge is then situated forward from the plane of the annular frame, such frame abuts against the second part at the distance of the hinge to stay in an backwards inclined position. The pivoting watch is then turned so that its dial appears on the hinge side.

This known construction is relatively complicated, in particular because of the pivoting mounting of the watch case. Moreover, the watch can practically not be carried in a pocket of a garment, because of the lug which projects with respect to the median plane of the case and the annular frame.

The present invention aims to improve a watch of the type indicated in the preamble, in particular the suspension and support device thereof, so that the watch can be passed from one position to the other in a very simple manner, without wearing out, and so that the assembly can be manufactured at low cost and requires a small amount of space, in particular without having projecting or inconvenient parts on the watch case and on the suspension and support device mounted on the case. A particular object consists of allowing this device to be mounted in a removable manner on a watch case, in order to be able to mount such case occasionally on another support, for example to use it as a wristwatch.

For this purpose, a watch according to the invention is characterised in that the case has a continuous or discontinuous groove on its periphery and in that the first part is secured to the case in a removable manner and comprises an open ring extending along the periphery of the case substantially in a median plane of the case, said ring being resilient in its plane in order to be secured by elasticity to the case and comprising catching means arranged to engage in said groove.

Likewise, a suspension and support device according to the invention is characterised in that the first part comprises an open ring arranged to extend along the periphery of the case, said ring being resilient in its plane in order to be secured to the case in a removable manner.

Thus, as long as the user wishes to use the watch with its suspension and support device, the first part of the latter may remain permanently secured to the watch case, thus without wearing out said case. In the suspension position, the second part may be suspended in a known manner, for example on a buckle or a small chain snap hook, and the first part with the watch is suspended therefrom simply by the hinge, which may play freely if necessary. In order to pass to the table position, it is sufficient to pivot the hinge until the two parts abut against each other and to place the second part flat on a horizontal surface. Such movements do not cause any wear and tear.

Moreover, since the suspension and support device is removable with respect to the watch, the watch will also be able to be used with another support. The configuration of the resilient catching means will preferably be adapted to the configuration of a peripheral groove arranged on a currently manufactured watch case, for example in moulded plastic, so that the device can be situated entirely within the median plane of the watch and thus proves less bulky when the watch is placed in a pocket. In the table position, the assembly can rest on a horizontal surface solely via the second part, which is preferably flat, so that it does not risk scratching such surface as a stand might do.

In the table position, the first part and the second part preferably abut against each other next to the hinge as a result of a shoulder provided on one of said parts by a recess arranged in the thickness of such part between the hinge and said shoulder. This system has the advantage of avoiding any projecting stop which could be inconvenient on one or other of the parts.

Other features and advantages of the present invention will appear in the following description of a preferred embodiment, given solely by way of example and with reference to the attached drawings, in which.

Figure 1:
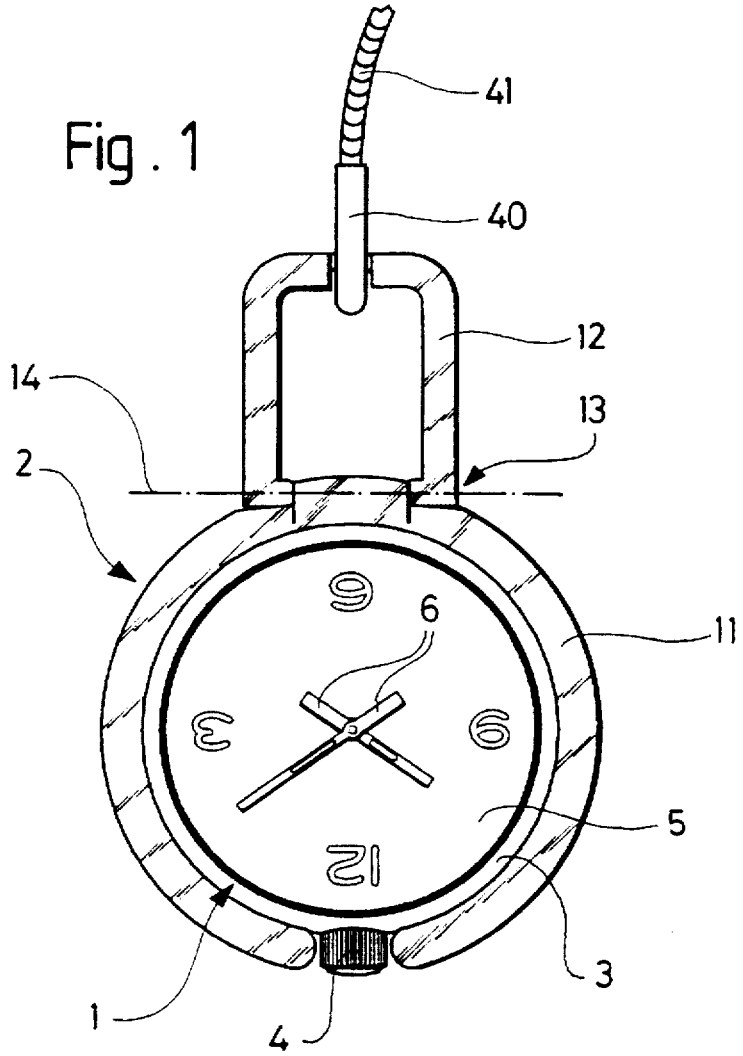
FIG. 1 is a front view of a watch according to the invention, in its suspension position.
Figure 2:
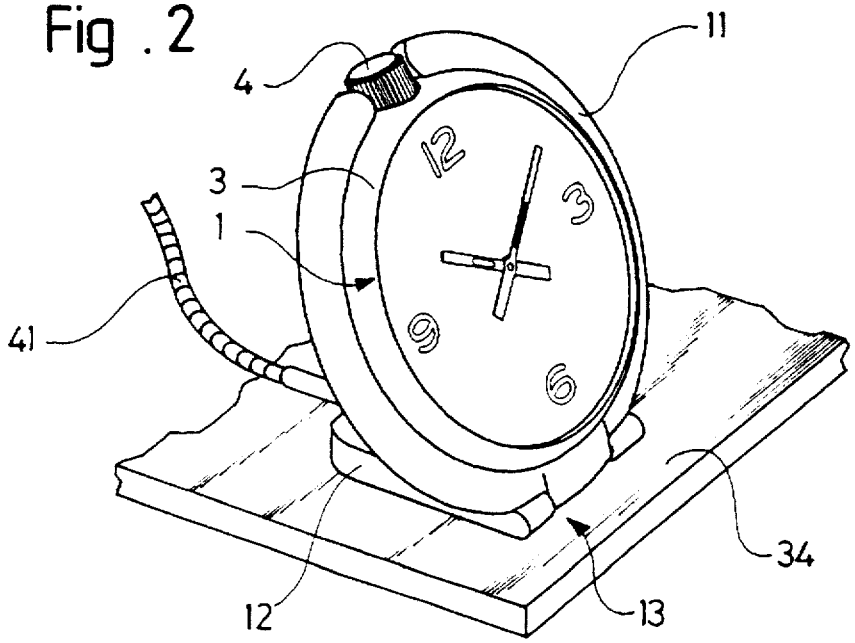
FIG. 2 shows the watch of FIG. 1 in its so-called table position.

The pocket and table watch shown in FIGS. 1 and 2 is formed of a conventional watch 1 and a suspension and support device 2 on which watch 1 is mounted in a removable manner. Watch 1 comprises a circular case 3 from which a control crown 4 emerges, the front face of the watch comprising a crystal 5 through which the time, indicated by conventional display elements 6, can be read. The structure and material of case 3 may be of any type, but it preferably concerns a moulded piece of synthetic material. A continuous groove 7 with a V profile, arranged substantially in the median plane 8 of case 3, extends along the periphery 9 of the case, except in the zone of crown 4. Watches of this type are marketed by Swatch AG, Bienne (Switzerland) under the brand name POP SWATCH and are intended to be mounted in a removable manner on a wristlet via catching means engaging in groove 7.

Figure 3:
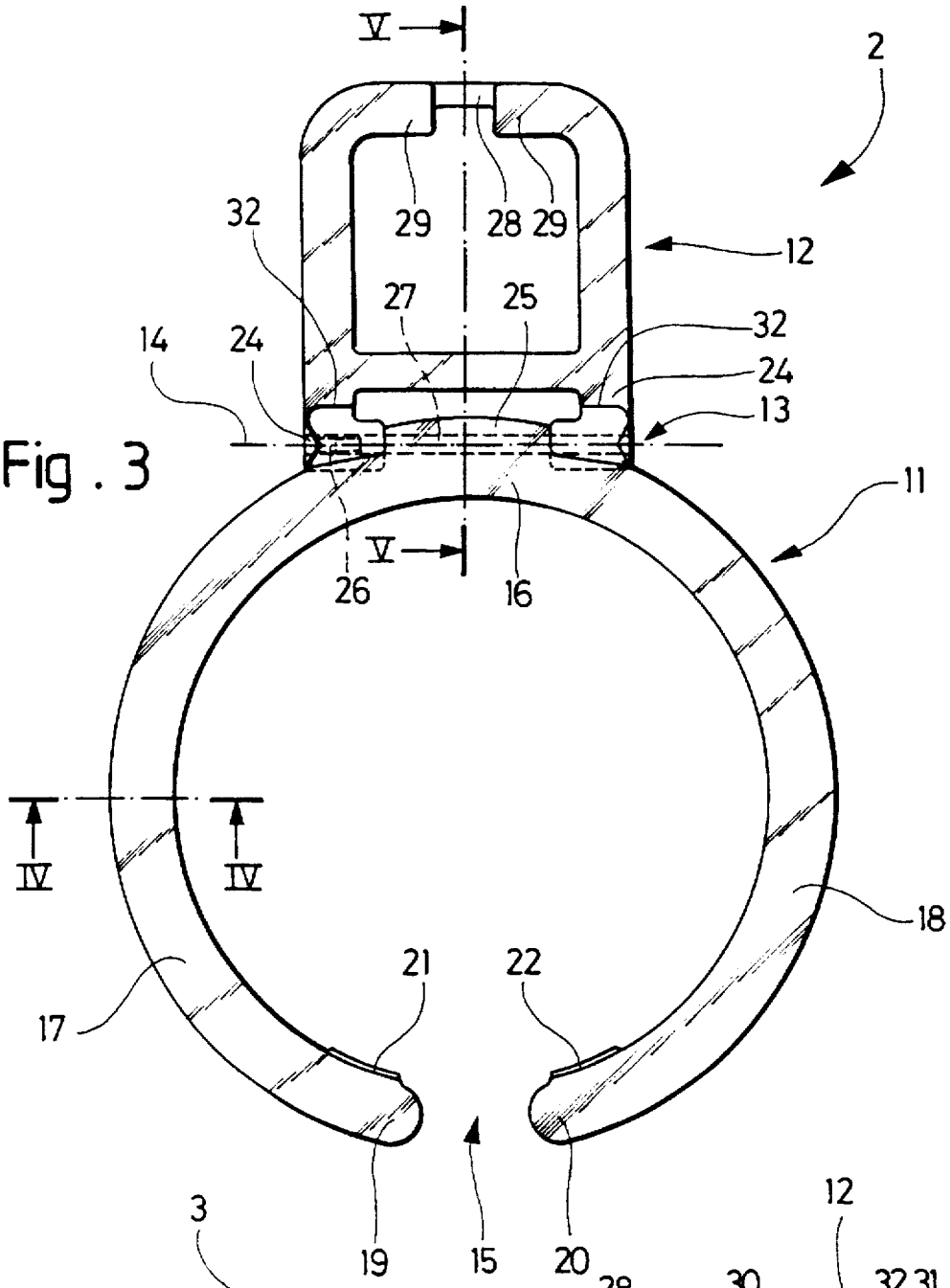
FIG. 3 is a back view of the suspension and support device of the watch of FIG. 1.
Figure 4:
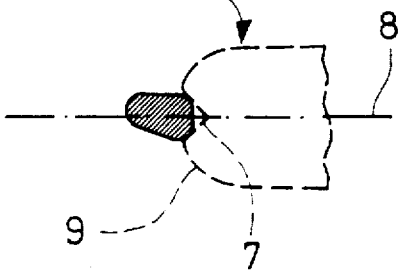
FIG. 4 is a cross-section along line IV—IV of FIG. 3.
Figure 5:
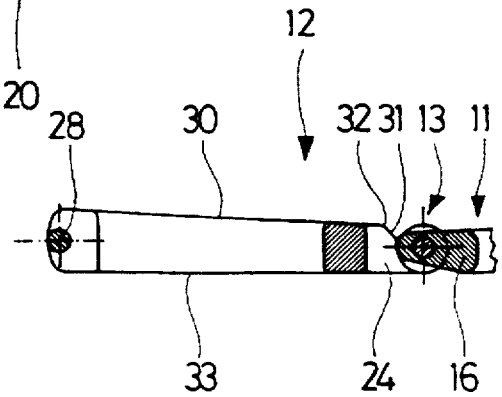
FIG. 5 is a cross-section along line V—V of FIG. 3.

Suspension and support device 2 is illustrated more particularly in FIGS. 3 to 5. It essentially comprises a first part 11 and a second part 12 which are attached by a hinge 13 having an axis 14. In this example, parts 11 and 12 are rigid and metallic, but they could be made of other materials, in particular synthetic materials. First part 11 has the shape of an open ring arranged to extend along periphery 9 of case 3, facing groove 7 so as to engage resiliently in such groove. The lateral opening 15 of this ring is intended to leave space for crown 4 (FIG. 1), so that the crown is situated opposite hinge 13. There can be seen in first part 11 a base portion 16, situated opposite opening 15 and connected to hinge 13, and two lateral arms 17 and 18 which are slightly flexible in the plane of the ring so that they can be spread apart for mounting or dismounting case 3 in or from part 11, both arms 17 and 18 then acting as catching elements in groove 7 for clamping case 3 between them. Close to free end 19, 20 of each arm 17, 18, a small projecting stop 21, 22 is provided, intended to abut against the bottom of groove 7 in order to guarantee precise positioning of case 3 in part 11. Both longitudinal and traverse locking is thus obtained, since an end of each stop 21, 22, on the side of opening 15, abuts against a corresponding end of groove 7. Watch 1 is thus fixed without play, via snap fitting, in suspension and support device 2. Second part 12 of device 2 has the general shape of a substantially flat and rectangular ring, but it could also take the form of a small arch or a plate pierced with a hole acting as suspension means. For its connection to part 11 by hinge 13, one end of part 12 has two brackets 24 pierced with a traverse hole, such two brackets being placed either side of a protuberance 25 of central part 16 of part 11. Such protuberance 25 is also pierced with a hole which is aligned with those of brackets 24. A hinge pin in the form of a screw 26 engaged in a cylindrical tubular nut 27, is placed in these three holes. It will be noted that hinge 13 is situated close to median plane 8 of case 3, which thus tends to remain vertical when the watch is suspended. In this position, both parts 11 and 12 extend substantially in the same plane 8, so that the watch requires little space, in particular when it is placed in a pocket of a garment. On the side opposite to hinge 13, the other end of part 12 is shaped to form a suspension element consisting of a thinner portion in the shape of a cylindrical small bar 28, allowing snap hook 40 of a small suspension chain 41 to be secured. The snap hook is held in a centered position on part 12 by thicker adjacent portions 29 of such part.

On the back face of part 12, i.e. on its face opposite to the front face of watch 1, there is provided a recess 31 arranged in the thickness of each of brackets 24 in order to provide beside such recess a non-projecting shoulder 32 which will be able to abut against base portion 16 of part 11 when part 12 is pivoted backwards to place the watch in its table position. In this position, the two parts form an acute angle and flat front face 33 of part 12 acting as pedestal will be able to rest on any horizontal surface 34, as is shown in FIG. 2. Part 11 and watch 1 are thus held in an upright position, slightly inclined backwards, so that their centre of gravity is situated approximately above the centre of part 12. The flat rectangular shape of part 12 assures good stability of the assembly. Crown 4 and the 12 o'clock position of the dial of the watch are then directed upwards, whereas they are directed downwards when the watch is suspended.

Multiple modifications or variants of the embodiment described hereinbefore may be envisaged without departing from the scope of the invention. For example, groove 7 could be discontinuous, first part 11 then having catching elements configured accordingly. Part 11 could have two arms of unequal length values, or even a single arm. Instead of two shoulders 32, a single shoulder or another element forming a stop could be provided, and this on either of the two parts 11 and 12. In all these variants, the suspension and support device according to the invention allows the watch to be worn in certain circumstances as a pocket watch or pendant watch, and in other circumstances to be placed in on a piece of furniture, in particular during the night or in the office.

Moreover, one can see that it is possible sometimes to remove watch 1 from the suspension and support device in order to mount it on a wristlet fitted with appropriate catching means, so as to make a wristwatch.

What is claimed is:

1. A pocket and table watch, comprising a watch case and a suspension and support device mounted on said case, said device comprising a hinge allowing the watch to be placed selectively in a suspension position and in a table position in which, when the watch is placed on a substantially horizontal surface, said device holds said case in a standing or inclined position with respect to said surface, said suspension and support device comprising two parts attached to each other by said hinge, namely a first part mounted on the periphery of said case and a second substantially flat part provided with a suspension means, said two parts abutting against each other to stop said first part at an acute angle with respect to said second part in said table position, wherein said case has a continuous or discontinuous groove on its periphery and a median plane, and wherein said first part is secured to said case in a removable manner and comprises an open ring extending along the periphery of said case substantially in said median plane, said ring being resilient in its plane in order to be secured to said case by elasticity and comprising catching means arranged to engage in said groove.

2. A watch according to claim 1, wherein a control crown of the watch is placed in a lateral opening of said ring.

3. A watch according to claim 1, wherein said catching means are arranged to lock in a longitudinal and traverse direction in said groove.

4. A watch according to claim 3, wherein said catching means comprise two projecting stops which abut against two ends of said groove in order to assure longitudinal locking.

5. A watch according to claim 1, wherein said hinge is arranged close to said median plane.

6. A watch according to claim 1, wherein said second art is a plate or a ring of a substantially flat shape, having one end connected to said first part by said hinge and an opposite end shaped to form said suspension means.

7. A suspension and support device mountable in a removable manner on a watch case, said device comprising a hinge allowing the watch to be placed selectively in a suspension position and a table position in which, when the watch is placed on a substantially horizontal surface, said device holds said case in a standing or inclined position with respect to said surface, said device comprising two parts attached to each other by said hinge, namely a first part removably securable to said case and a second substantially flat part provided with a suspension means, said two parts abutting against each other to stop said first part at an acute angle with respect to said second part in said table position, wherein said first part comprises an open ring arranged to extend along the periphery of said case, said ring being resilient in its plane to be secured to said case in a removable manner.

8. A device according to claim 7, wherein said first part and said second part, in said table position, abut against each other close to said hinge as a result of a shoulder provided on one of said parts by a recess arranged in the thickness of such part between said hinge and said shoulder.

9. A device according to claim 7, wherein said second part is a plate or a ring of a substantially flat shape and has one end connected to said first part by said hinge and an opposite end shaped to form said suspension means.

10. A device according to claim 9, wherein, in said suspension position, said two parts extend substantially in a same plane in which said hinge is also situated.

* * * * *